US005620094A

United States Patent [19]

Naumann

[11] Patent Number: 5,620,094

[45] Date of Patent: Apr. 15, 1997

[54] WRAP-AROUND CARRIER WITH TOP DIVIDER TAB

[75] Inventor: Frederick Naumann, Old Tappan, N.J.

[73] Assignee: Riverwood International Corporation, Atlanta, Ga.

[21] Appl. No.: 651,072

[22] Filed: May 21, 1996

[51] Int. Cl.[6] ..... B65D 71/18

[52] U.S. Cl. ..... 206/434; 206/149; 206/427; 206/431

[58] Field of Search ..... 206/427, 429, 206/430, 431, 434, 435, 140, 148, 149, 139

[56] References Cited

U.S. PATENT DOCUMENTS

| | | | |
|---|---|---|---|
| 3,049,282 | 8/1962 | Chidsey, Jr. et al. | 206/149 |
| 3,156,404 | 11/1964 | Wood | 206/149 |
| 3,167,213 | 1/1965 | De Paul | 206/434 |
| 4,164,286 | 8/1979 | Sutherland | 206/434 |
| 4,703,847 | 11/1987 | Oliff | 206/434 |
| 5,439,112 | 8/1995 | De Guglielmo et al. | 206/434 |
| 5,484,059 | 1/1996 | Sutherland | 206/434 |

*Primary Examiner*—Bryon P. Gehman
*Assistant Examiner*—Luan K. Bui

[57] ABSTRACT

A wrap-around tub carrier with a top center divider tab. The tab is comprised of spaced segments of a flap which is foldably connected to the top panel. Both the divider tab and a locking tab located between the divider tab segments are connected by a fold line to another locking tab. Both locking tabs extend up to engage the flange of adjacent tubs on opposite sides of the divider tab. A triangular keel extends up between the rows of tubs and a keel support tab extends up within the keel to provide additional support.

18 Claims, 2 Drawing Sheets

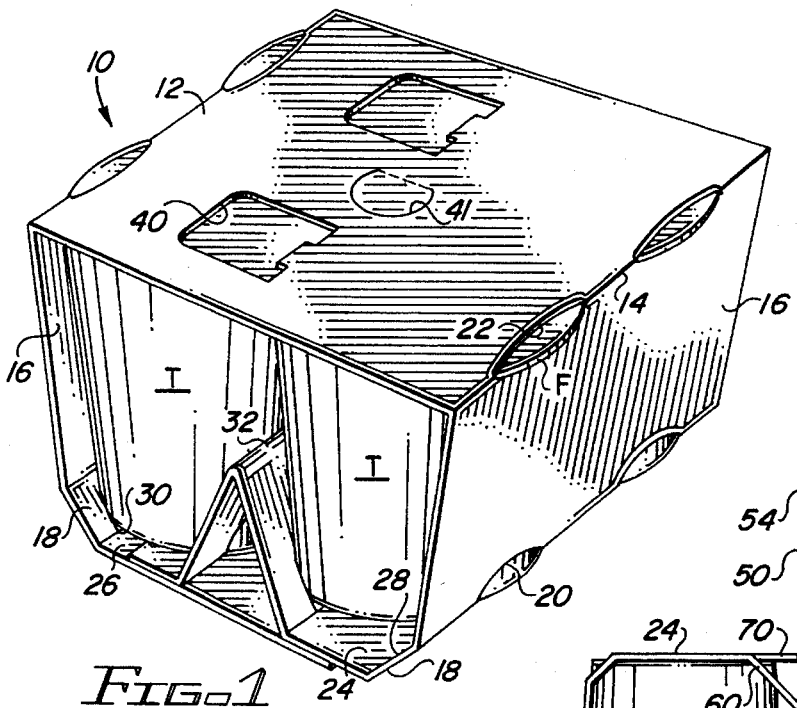
FIG. 1
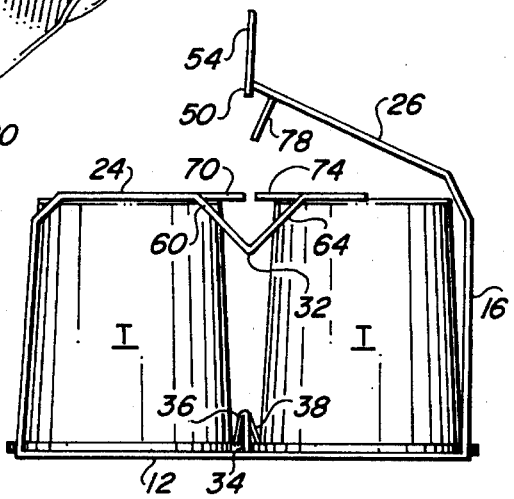
FIG. 8
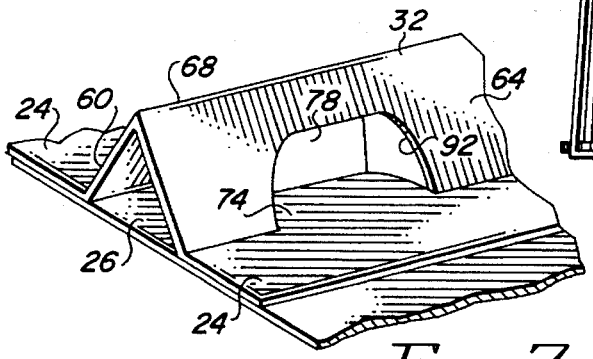
FIG. 7
FIG. 2
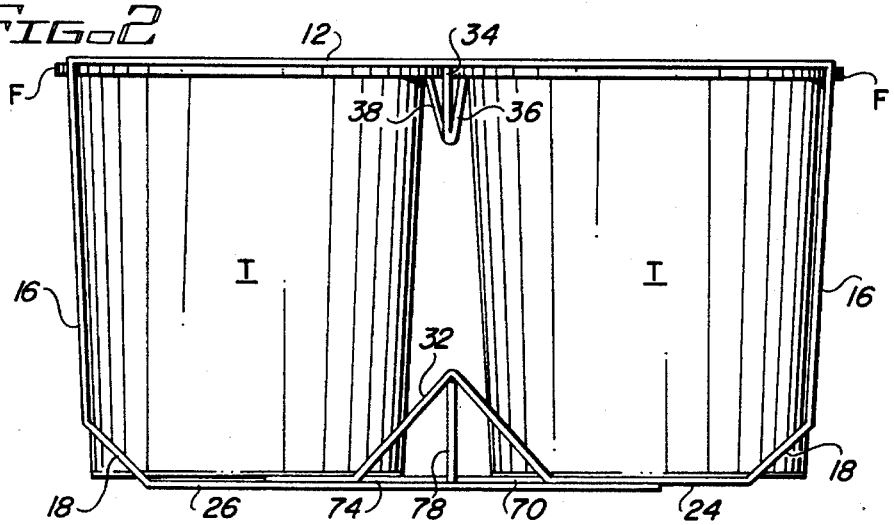

WRAP-AROUND CARRIER WITH TOP DIVIDER TAB

FIELD OF THE INVENTION

This invention relates to wrap-around article carriers. More particularly, it relates to wrap-around article carriers for packaging tapered articles, such as tubs of the type which contain soft food products.

BACKGROUND OF THE INVENTION

Wrap-around article carriers are commonly designed to have ends which are either partially or entirely open. In either case the carriers must be provided with means for securely holding the articles in place. Beverage cans, for example, are held in place partly by the tension of the tightly wrapped carrier and by engagement of the top and bottom flanges of the cans with the edges of cutouts in the side panels of the carrier. That design is facilitated by the fact that the side walls of beverage cans are of substantially constant diameter, which allows the carrier blank to be tightly wrapped around the cans.

Problems arise when the articles are not of uniform dimensions, particularly when the articles are tapered toward the bottom, which causes the bottom portions of articles in adjacent rows to be spaced apart. Wrap-around carriers for use with tapered tubs of the type used as soft food containers are especially troublesome because of the difficulty in wrapping them tightly enough to prevent movement of the tubs when the package is lifted and carried. Movement of the containers is a problem even when the carrier includes side slots through which flanges on the tops of the tubs protrude, since such an arrangement does not hold the bottom portions of the tubs tightly in place. Centrally located bottom panel keels have been provided to engage containers in adjacent rows and prevent the bottom portions of the containers from moving toward each other, but this does not alleviate the problem at the tops of the containers. When a package is picked up by finger holes in the top panel the tendency of the package to bend somewhat at the middle can cause adjacent portions of the top flanges of the containers to overlap. This flange overlapping, known as shingling, allows undesirable relative movement between the containers and can cause the package to deform.

It would be desirable to have a wrap-around carrier which prevents shingling as well as stabilizing the bottoms of the articles, and it is an object of the invention to provide such a carrier.

BRIEF SUMMARY OF THE INVENTION

In accordance with the invention, a wrap-around carrier is provided for packaging a plurality of adjacent rows of articles, each of which has an upper flange. A divider panel flap comprised of upper and lower portions is foldably connected to the top panel of the carrier and extends down into the interior of the carrier. The upper portion of the flap includes a divider tab which extends downwardly between the flanges of articles in the adjacent rows. The upper portion also includes a first upwardly extending locking tab which engages the underside of an article flange in one of the rows. The lower portion is comprised of a second upwardly extending locking tab which engages the underside of the flange of an associated article in the adjacent row.

In a preferred arrangement the divider tab is comprised of spaced segments, with the first locking tab being located between the spaced segments and with the second locking tab being connected to both the divider tab and the first locking tab along a second fold line substantially parallel to the first fold line. The first locking tab is offset from the foldable connection of the divider tab to allow the locking tab to move into locking position without snagging on an adjacent article flange.

In addition to the divider tab, a keel may be provided to extend up from the bottom panel between the rows of articles to stabilize the lower portion of the articles.

The carrier is highly effective in preventing the upper portions of packaged articles from moving or from shingling when the package is lifted by the finger holes. It is economical and simple to fabricate from a unitary blank, and is especially useful in the packaging of tapered tub-shaped articles. The above and other aspects of the invention, as well as other benefits, will readily be apparent from the more detailed description of the preferred embodiment which follows.

BRIEF DESCRIPTION OF THE DRAWING

FIG. 1 is a pictorial view of a wrap-around carrier incorporating the divider tab arrangement of the invention;

FIG. 2 is an end view of the carrier of FIG. 1;

FIG. 7 is a partial pictorial view of the bottom panel of the carrier, showing a portion of the triangular keel; and FIG. 8 is an end view of a package at an intermediate stage of formation.

DETAILED DESCRIPTION OF THE PREFERRED EMBODIMENT

Figure 3:
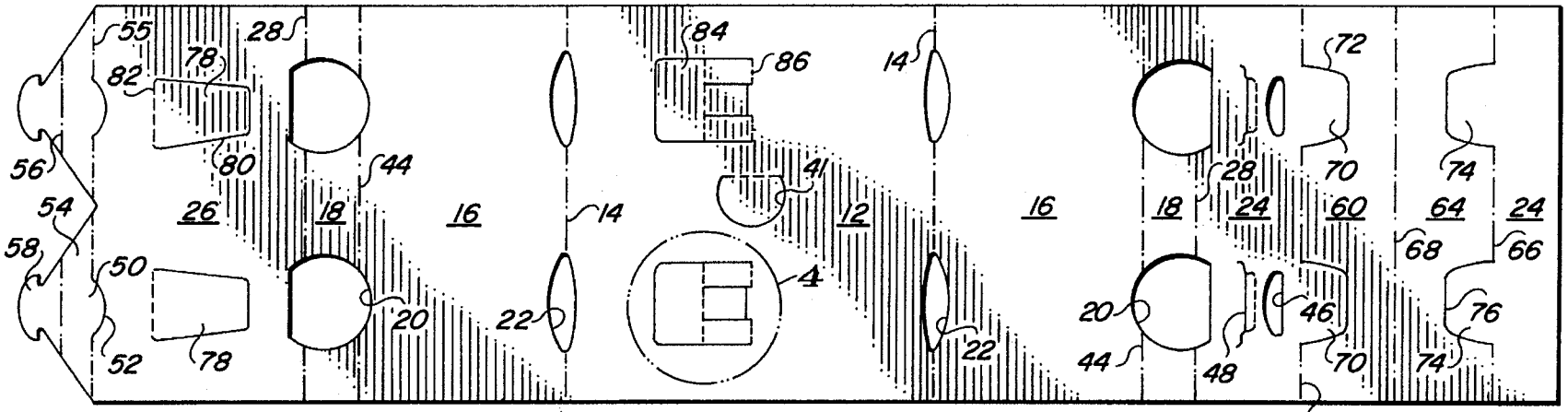
FIG. 3 is a plan view of a blank for forming the carrier of FIG. 1.

Referring to FIGS. 1 and 2, a wrap-around carrier 10 designed to package two rows of tubs T comprises a top panel 12 connected along fold lines 14 to side panels 16. The side panels are tapered at the bottom portion of the carrier to form bevel panels 18 which include cutouts 20 through which the bottom portions of the tubs extend. Adjacent portions of the side and top panels also include cutouts 22 through which the flanges F of the tubs T extend. Other arrangements for gripping the top and bottom edges of the tubs, such as specially designed cutout flaps, may be provided if desired.

The bottom panel of the carrier is formed by overlapped inner and outer bottom panel flaps 24 and 26. The inner bottom panel flap 24 is connected to one of the side panels 16 along fold line 28 while the outer bottom panel flap 26 is connected to the other side panel 16 along fold line 30. Extending up from the bottom panel between the rows of tubs is center keel 32, which is open-ended and triangular in transverse cross-section. The center keel fits snugly between the tapered lower portions of the tubs T, preventing them from moving toward each other and enabling the blank forming the carrier to be wrapped tightly about the tubs. As explained in more detail below, the keel is integrally connected to the inner bottom panel flap 24.

Completing the carrier structure are center divider tabs 34 which extend down from the top panel 12, separating and engaging the flanges F of the adjacent rows of tubs. In addition, locking tabs 36 and 38 extend up at an angle from the divider tabs to engage the upper portions of the tubs, either directly against the underside of the tub flanges F or just beneath them, locking the upper portions of the tubs in place and preventing shingling. The top panel 12 includes openings 40 from which the divider and locking tabs are formed, and a finger hole 41 which can be used to lift the carrier. Other reference numerals shown in FIG. 2 which have not been mentioned will be referred to later.

Referring to FIG. 3, wherein like reference numerals to those used in FIGS. 1 and 2 denote like elements, a blank 42 for forming the carrier 10 comprises a substantially rectangular sheet of paperboard or other suitable material having adequate flexibility and strength. The top panel section 12 is located in the interior of the blank and is connected to the side panel sections 16 by the fold lines 14. The side panel sections in turn are connected to the bevel panel sections 18 by fold lines 44. The inner bottom panel flap 24 includes two spaced primary locking openings 46 and two secondary locking slits 48, while the outer bottom panel flap 26 includes two primary locking tabs 50 formed by slits 52 and two secondary locking tabs 54. Fold lines 55 extending from the ends of the slits 52 connect the secondary locking tabs 54 to the bottom panel flap 26, and transverse fold lines 56 in the secondary locking tabs form outer tab portions 58. The primary locking tabs 50 are aligned with the primary locking openings 46 while the secondary locking tab portions 58 are aligned with the secondary locking slits 48.

Figure 4:
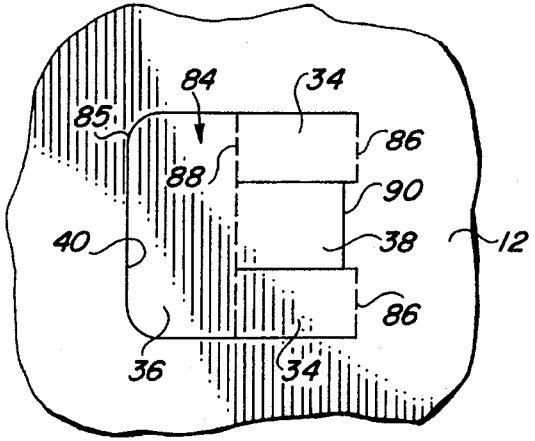
FIG. 4 is an enlarged plan view of the area within the circle 4 of FIG. 3.

The inner bottom panel flap 24 is separated into two spaced sections by a first keel panel section 60, which is connected to the interior portion of the bottom panel flap 24 by fold line 62, and a second keel panel section 64, which is connected to the end portion of the bottom panel flap 24 by fold line 66. The first and second keel panel sections are connected to each other by fold line 68. Interrupting the fold line 62 are two spaced tabs 70 formed by slits 72. Similar oppositely facing tabs 74 formed by slits 76 interrupt the fold line 66. In addition, keel support tabs 78 are formed in the outer bottom panel flap 26 by slits 80. The tabs 78, which are connected to the bottom panel flap 26 by fold lines 82, are aligned with the tabs 70 and 74 in the inner bottom panel flap. As best shown in FIG. 4, the openings 40 in the top panel section 12 are covered by flaps 84 from which the top divider tab structures are formed. Each flap 84 is connected to the top panel section along spaced fold lines 86 and is separated from the top panel section by U-shaped slit 85, the ends of which terminate at the outer ends of the fold lines 86. Interior fold line 88 extends the length of the flap 84 and is substantially parallel to the fold lines 86. A smaller U-shaped slit 90 is formed so that the ends of the slit meet the fold line 88, while the base of the slit is parallel to, but slightly inwardly offset from, the fold lines 86. The large lower section of the flap 84 defined by the slit 85 and the fold line 88 forms the second upwarding extending locking tab 36, the small section defined by the U-shaped slit 90 and the fold line 88 forms the first upwardly extending locking tab 38, and the small sections defined by the slits 85 and 90 and the fold lines 86 and 88 form spaced downwardly extending divider tabs 34. The tabs 34 and 38 form the upper section of the flap 84. Preferably, the length of the tab 36, as measured between the base portion of the slit 85 and the fold line 88, is substantially the same as the length of the tab 38, as measured from the base of the slit 90 to the fold line 88.

Figure 5:
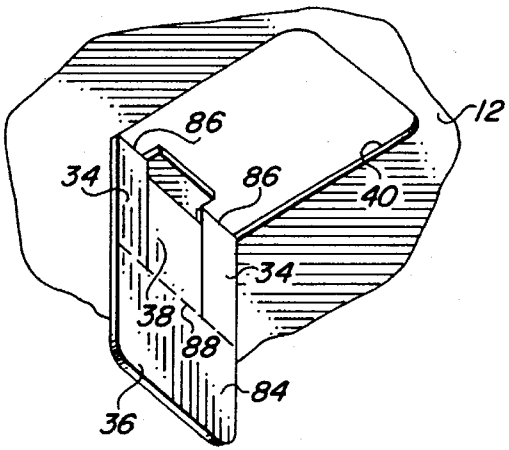
FIG. 5 is a partial pictorial view of the underside of the top panel of the carrier after the divider-forming flap has been punched out and folded.
Figure 6:
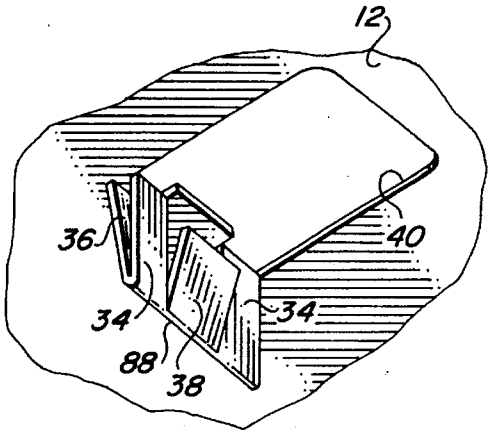
FIG. 6 is a partial pictorial view similar to that of FIG. 5, but showing the flap after a further folding operation.

To actuate the center divider tabs, the flaps 84 are punched out of the blank and folded about the fold lines 86, as illustrated in FIG. 5, so as to extend transversely away from the outer surface of the blank. The large locking tab section 36 of each flap 84 is then folded about the intermediate fold line 88 toward the top panel in a direction which moves it away from the opening 40 vacated by the flap 84. This action causes the smaller locking tab 38 to move out of the plane of the divider tabs 34 and pivot in the opposite direction about the fold line 88. The final positions of the divider tab 34 and the locking tabs 36 and 38 resulting from this folding operation are illustrated in FIG. 6.

To form a package, a blank is positioned on a support with the inner surface of the blank facing upward. Two rows of tubs are then placed in inverted condition on the inner face of the top panel section so that their flanges F are spaced a sufficient distance from the flaps 84 to allow the flaps to be punched from the top panel section and folded in the manner described. It can be appreciated from FIGS. 4, 5 and 6 that the distance which the slit 90 of a flap 84 is spaced from the fold lines 86 allows the locking tab 38 to pivot into position without snagging on the flange of an adjacent tub. At the same time the side panel sections 16 of the blank are folded up to the vertical, pushing the tubs T toward the upright divider tabs 34. As the side panel sections reach their final relative positions the flanges F of adjacent tubs abut the divider tabs 34 and the ends of the folded locking tabs 36 and 38 contact the underside of the flange of associated tubs in the relationship illustrated in FIG. 2.

To complete fabrication of the package the keel sections 60 and 64 are folded out of the plane of the bottom panel flap 24 to form the triangular keel. When this occurs the keel tabs 70 and 74 remain in the plane of the bottom panel flap 24, leaving openings in the keel sections where the keel tabs were originally located. This arrangement is illustrated in FIG. 7, which shows opening 92 in keel section 64 formed as a result of this folding operation. The side panel sections are then pulled tight about the tubs and the bottom panel flaps are moved into place. As shown in FIG. 8, bottom panel flap 24 is positioned first, so that the triangular keel 32 is positioned between the bottoms of the tubs, with the lower portions of the tubs extending through the openings in the keel sections. Bottom panel flap 26 is then moved into place after keel support tabs 78 have been punched out. This allows the keel support tabs 78 to extend between the spaced ends of the keel tabs 70 and 74 to the apex of the triangular keel, assuming the position illustrated in FIGS. 2 and 7.

To complete formation of the bottom panel, the secondary locking tabs 54 are folded back along the fold line 55 and the primary locking tabs 50 are inserted into the primary locking openings 46. The end portions 58 of the secondary locking tabs 54 are then folded down and inserted through the secondary locking slit 48 to secure the bottom panel flaps together.

Although it is preferred to form a package with the tubs inverted, it will be understood that a package could also be formed with the tubs in upright position. The carrier need not be limited to a design for carrying four tubs, but may be extended in length to hold greater numbers, provided they are arranged in two adjacent rows. If additional tubs are packaged additional finger holes may be provided. For example, if two rows of three tubs each are packaged, two finger holes preferably would be provided, one between the middle tub and each adjacent end tub. When two finger holes are provided the deterrent effect of the top divider and the locking tabs against shingling of the upper tub portions is even more apparent.

It can now be appreciated that the invention provides a carrier which holds the tapered tubs in an upright position to protect against movement of both the upper and lower tub portions. The top center divider not only abuts adjacent tub flanges but includes associated locking tabs which prevent unwanted shingling or other movement of the upper portions of the tubs. The carrier is formed from a single blank even though it includes the divider and keel structure. In addition, the carrier blank is economical to produce and fabrication of the carrier is simple.

Although the invention has been described in connection with tub-shaped articles, it may also be employed to hold articles of different shapes in a wrap-around carrier having a center keel. It should also be apparent that the invention need not be limited to all the specific details described in connection with the preferred embodiment, but that changes to certain features of the preferred embodiment which do not alter the overall basic function and concept of the invention may be made without departing from the spirit and scope of the invention, as defined in the claims.

What is claimed is:

1. A package comprised of a wrap-around article carrier containing a plurality of adjacent rows of adjacent articles, each article having an upper portion including a flange, comprising:

a top panel;

a bottom panel;

opposite side panels connected to the top and bottom panels; and a divider panel flap connected to the top panel by a first fold line and extending downwardly therefrom;

the divider panel flap being comprised of an upper second and a lower section;

the upper section of the divider panel flap including a divider tab extending downwardly between the flanges of articles in adjacent rows and a first locking tab extending upwardly and engaging the underside of the flange of an associated article in one of the rows; and the lower section of the divider panel flap being comprised of a second locking tab extending upwardly and engaging the underside of the flange of an associated article in the adjacent row.

2. A package as defined in claim 1, wherein the second locking tab is connected to the divider tab along a second fold line substantially parallel to the first fold line.

3. A package as defined in claim 2, wherein the first locking tab is connected to the second locking tab along a fold line which is substantially aligned with the second fold line.

4. A package as defined in claim 3, wherein the divider tab is comprised of spaced segments, and the first locking tab is connected to the second locking tab between the spaced segments.

5. A package as defined in claim 4, wherein the top panel includes an opening corresponding in shape to the divider panel flap, the first fold line extending along an edge of the opening and being comprised of spaced segments corresponding to the spaced segments of the divider tab.

6. A package as defined in claim 5, wherein said edge of the opening includes a tab coextensive with the top panel, the coextensive top panel tab extending inwardly into the opening so as to be offset from the first fold line.

7. A package as defined in claim 1, wherein the flanges of adjacent articles of adjacent rows are in contact with opposite sides of the divider tab.

8. A package as defined in claim 7, wherein the articles are tub-shaped.

9. A package as defined in claim 1, wherein the bottom panel is comprised of a first bottom panel flap connected at a side edge thereof to one of the side panels and a second bottom panel flap connected at a side edge thereof to the opposite side panel, the bottom panel including a keel extending substantially parallel to the side edges of the bottom panel flaps and being substantially equally spaced from the side panels, the keel being comprised of a plurality of keel panels, each keel panel being connected to an adjacent keel panel by a fold line, and one of the keel panels being connected by a fold line to the first bottom panel flap.

10. A package as defined in claim 9, wherein the keel is triangular in transverse cross-section.

11. A package as defined in claim 10, wherein the keel panels include opposite openings through which portions of adjacent articles extend.

12. A package as defined in claim 11, wherein the second bottom panel flap includes a keel support tab associated with the opposite keel panel openings, each keel support tab extending upwardly into the keel to the apex of the triangular keel.

13. A blank for forming a wrap-around carrier for packaging a plurality of adjacent rows of adjacent articles, each article having an upper portion including a flange, comprising:

a generally rectangular sheet having an interior top panel section;

side panel sections connected to opposite sides of the top panel section by fold lines;

a first bottom panel flap connected to one of the side panel sections along a first fold line and a second bottom panel flap connected to the other side panel section along a second fold line;

a divider panel flap connected to the top panel by a first fold line and being located so as to extend downwardly between adjacent rows of articles in a carrier formed from the blank;

the divider panel flap being comprised of a first section and a second section;

the first section of the divider panel flap being connected to the second section of the divider panel flap by a second fold line substantially parallel to the first fold line; and the first section of the divider panel flap including a divider tab and a first locking tab and the second section of the divider panel flap being comprised of a second locking tab.

14. A blank as defined in claim 13, wherein the divider tab is comprised of spaced segments connected to the top panel section by spaced segments of the first fold line, and the first locking tab is connected along the second fold line to the second locking tab between the spaced segments.

15. A blank as defined in claim 14, wherein the first locking tab is separated from the top panel section by a slit, the slit being substantially parallel to the first fold line segments but being offset therefrom so as to form a top panel tab extending inwardly into the divider panel flap.

16. A blank as defined in claim 13, wherein the first bottom panel section includes a plurality of keel panel sections, each keel panel section being connected to an adjacent keel panel section by a fold line.

17. A blank as defined in claim 16, wherein there are two keel panel sections for forming a keel of triangular transverse cross-sectional shape, the keel panel sections including opposite openings through which lower portions of adjacent articles in a carrier formed from the blank may extend.

18. A blank as defined in claim 17, wherein the second bottom panel flap includes a keel support tab associated with the opposite keel panel openings, each keel support tab extending upwardly into the triangular keel of a carrier formed from the blank to the apex of the triangular keel.

* * * * *